United States Patent [19]

LaChance

[11] Patent Number: 4,991,808

[45] Date of Patent: Feb. 12, 1991

[54] MOVABLE UTILITY BRACKET FOR LADDERS

[76] Inventor: Paul LaChance, 135 North Main St., West Bridgewater, Mass. 02379

[21] Appl. No.: 405,936

[22] Filed: Sep. 12, 1989

[51] Int. Cl.[5] ..... E06C 7/00

[52] U.S. Cl. ..... 248/211; 248/911; 248/311.2; 182/106

[58] Field of Search ..... 248/211, 210, 238, 311.2, 248/911, 298; 182/129, 106, 116, 121

[56] References Cited

U.S. PATENT DOCUMENTS

| | | | |
|---|---|---|---|
| 679,887 | 8/1901 | Clark | 248/211 |
| 1,221,658 | 4/1917 | Berry | 248/210 |
| 2,542,737 | 2/1951 | Vogel | 248/211 X |
| 2,883,134 | 4/1959 | O'Halloran | 248/210 |
| 3,940,824 | 3/1976 | Gioia et al. | 248/210 X |
| 3,980,264 | 9/1976 | Tomasik | 248/210 |
| 4,266,746 | 5/1981 | Klaiber | 248/210 X |
| 4,515,242 | 5/1985 | LaChance | 248/238 X |

FOREIGN PATENT DOCUMENTS

| | | | |
|---|---|---|---|
| 2094874 | 9/1982 | United Kingdom | 248/238 |

*Primary Examiner*—Karen J. Chotkowski

*Attorney, Agent, or Firm*—John P. McGonagle

[57] ABSTRACT

A sleeve fits securely over a ladder rail with attached hooks over at least two rungs of the ladder. Interchangeable hook components may be rounded recessed hooks for extension-type ladders or flat angled hooks for step ladder. The hook components are adjustably attached to the sleeve. Brackets for utility attachments are pivotally secured to the sleeve with two bolts through a half circle slot and central hole through the sleeve. Paint buckets, paint trays and utility trays may all be pivotally attached. A hand railing, safety railing support and holder for paint brushes and other tools may also be attached.

5 Claims, 4 Drawing Sheets

MOVABLE UTILITY BRACKET FOR LADDERS

BACKGROUND OF THE INVENTION

1. Technical Field

The present invention relates to ladder attachments and in particular to movable brackets hooked onto the rungs and around the side rail with means for attaching painting supplies, tools, a hand rail and safety rail support.

2. Description of the Prior Art

Mast brackets and holders for equipment on ladders are either very loosely connected to the ladder, such as removable hooks and the like, or very rigidly attached to the ladder and not easily moved. This results in spilling paint or dropping tools with the loose brackets and in having to move back and forth from the work position to the bracket position on the ladder if the broacket remains secured to one place on the ladder.

Most work ladders do not provide handrails for safety in using the ladder. In some cases, such as firefighting apparatus, or permanently instlaled ladders used in place of stairs as on a ship, the handrails are permanently secured to the ladders and would be very difficult to remove or shift in position on the ladder.

A rigidly attached tool holder would not take into account various angles of ladder positioning and would not always be in the optimum orientation for maintaining tools, supplies and paint in the proper orientation for ease of handling and not spilling.

Most ladder attacdments are not reversible on the ladder for both left and right side rail use.

Most other ladder brackets are designed for use with only one type of ladder.

No other utility brackets serve also as supports for staging safety rails and supply holders.

DISCLOSURE OF INVENTION

A primary object of the present invention is to provide a stable bracket for ladders which can be moved swiftly and easily up and down the ladder wherever required by the user. This object is accomplished by constructing a front-mounted bracket with a sleeve to fit over the ladder side rail and hooks toengage at least two rungs of the ladder.

Another object of the invention is to provide a utility bracket which may be used both on extension-type ladders and step ladders by switching the adjustable interchangeable hooks.

Another object of the invention is to provide, attached to the bracket, a handrail which serves as a safety grip within easy reach to maintain proper balance on the ladder.

By providing an elongated hook over at least one rung with a bolt or other removable fastener between the end of the hook and the opposing side of the hook (thereby encircling the rung), the bracket can remain on the ladder while moving or storing and the bracket may be used interchangeably on either ladder side rail.

Providing a half circle slot as a pivot means on the utility bracket permits pivoting utility device brackets mounted thereon to provide the proper orientation regardless of the angle of the ladder.

Providing a paint bucket holder on the utility bracket enables large surfaces to be painted without having to come down from the ladder to get more paint.

An elongated support inserted into the openings in the ladder rungs as well as attached to the handrailing on the utility bracket provides a very secure means for supporting a safety railing when the ladder is used horizontally as staging.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
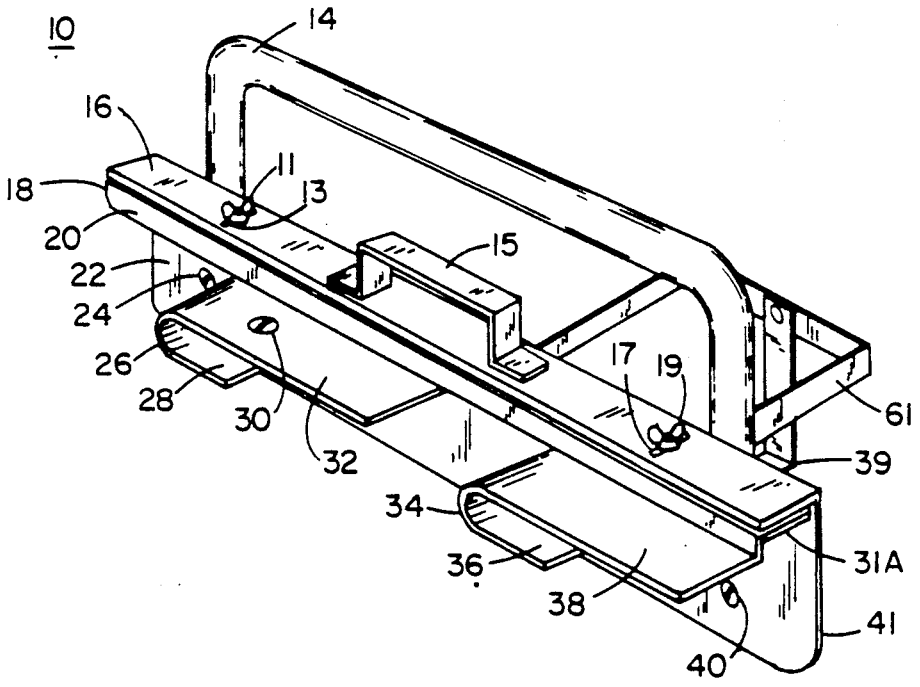
FIG. 1 is a perspective view of the movable utility bracket having a hook component for extentsion-type ladders and a handrail and bracket for mounting a paint bucket and utility tray.
Figure 2:
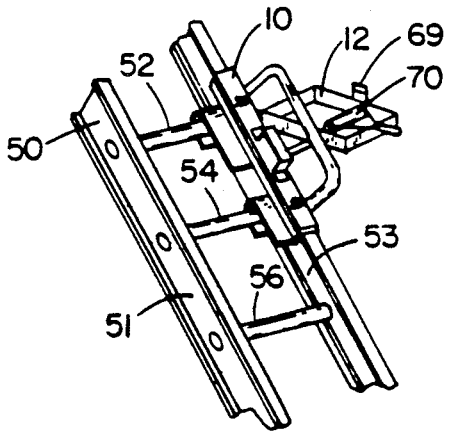
FIG. 2 is a partial perspective view of an extension-type ladder and mounted on the ladder a utility bracket mounted with a handrailing and a paint tray and roller.

In FIGS. 1 and 2 a movable utility bracket for ladders 10 comprises a sleeve 41 contacting and conforming to a side rail 53 of a ladder 50. The sleeve extends over a length of the side rail equal to a distance between at least two ladder rungs 52 and 54, wherein a narrow elongated section 16 of the sleeve covers a top edge of the side rail of the ladder and, extending orthogonally from the narrow elongatd section, an elongated wide section 22 covering the external side of the rail. Permanently secured to a top central portion of the sleeve a handle 15 for moving the utility bracket.

At least two hooks 26 and 34 protrude interiorly from the sleeve, each of which hooks partially encircles one of the rungs 52 and 54 over a top of the rung, thereby providing a bracket which slides onto a ladder hooked over the rusgs of the ladder securely but instantly removable to other rungs on the ladder. The two hooks 24 and 34 are attached together by a narrow elongated rigid strip 31A which underlies the narrow elongated section 16 of the sleeve and the hooks are adjustably and removably attached to the sleeve by bolts 11 and 19 through slots 13 and 17 in the narrow elongated section of the sleeve and mating holes (not shown) in the elongated riged strip 31A of the hook component.

Any of a number of bracket means such as the U-shaped bracket 39 for supporting a utility tray and enclosed bracket 61 pivotally attached to the U-shaped bracket for supporting a paint bucket. A handrail 14 is also secured to the utility bracket by bolts or screws 24 and 40 through the sleeve. Other possible brackets mounted to the sleeve include a bracket support for a paint tray 12 pivotally to the utility bracket, and a bracket support 57 for a painting tool 59 and other tool 58 such as a putty knife.

The invention of FIG. 1 provides hooks 26 and 34 arched away from the narrow elongated rigid strip 31A to conform to the rungs of an extension ladder. The hooks are spaced a short distance from the narrow elongated rigid strip by a narrow panel 20 corresponding to the distance between an edge of a side railing and a rung on an extension ladder.

Figure 7:
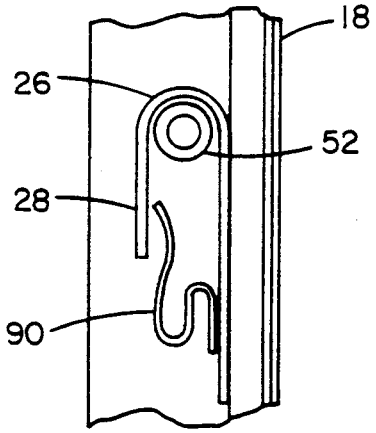
FIG. 7 is a partial elevational view partially in section showing a rung hook having a safety means for retaining the rung in the hook.

In FIG. 7 an additional resilient arched strip 90 is secured within at least one of the arched hooks 26 so that the arches are in opposing directions and the internal arched strip extends across the width of the arched hook, so that when the arched hook is slipped over a ladder rung 52 the interior arched strip moves to admit the rung and then springs back to secure the rung within the arched hook. Alternately, in FIG. 1 the hooks may further comprises alternate securing means such as a bolt means 30 across at least one opening across one hook to secure the hook around a ladder rung so that the utility bracket may be attached to a bottom side of a ladder on one side rail with a matching utility bracket on the other side rail so that the ladder may be rested on the hand railings against an external surface.

Figure 3:
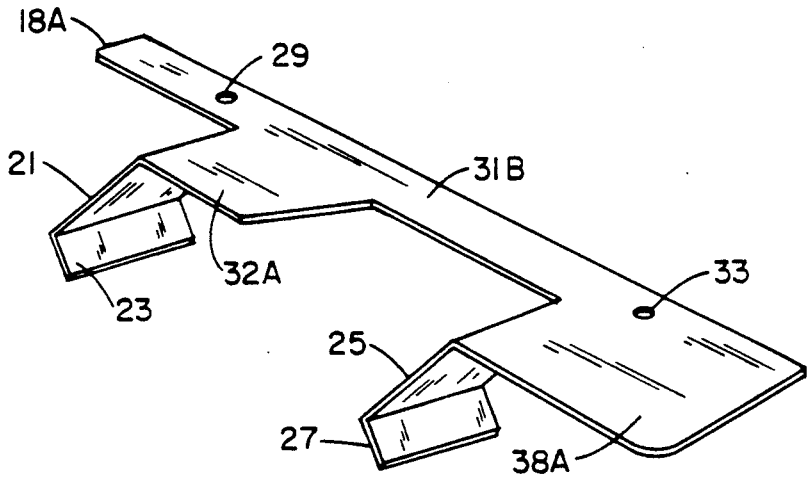
FIG. 3 is a perspective view of an alternate hook component for a step ladder.
Figure 4:
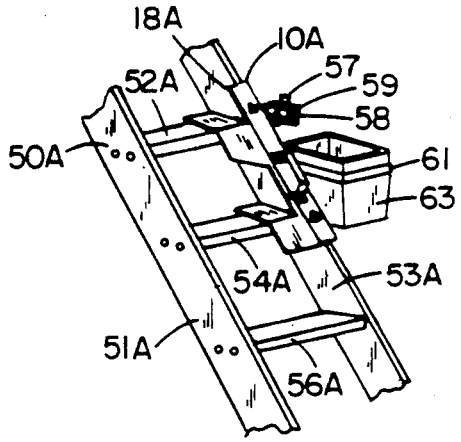
FIG. 4 is a partial perspective view of a step ladder and mounted on the step ladder a utility bracket mounted with a bracket holding a paint bucket and a holder for paint brushes and tools.

In FIGS. 3 and 4 showing an alternate hook component 18A, a base of each hook 32A and 38A is a flat extension of the narrow elongated rigid strip 31B and each hook is formed of a flat rectangular arm 21 and 25 bent at an angle away from the base of the hook, which angle corresponds to an angle between a side rail 53A and a rung 52A or 54A on a step ladder. A smaller rectangular end 23 and 27 bends away from the flat rectangular arm at an a right angle and extends a distance approximately equal to the thickness of a rung on a step ladder and hooks over the step ladder rung. Two holes 29 and 33 through the narrow elongated strip 31B mate with the two slots 13 and 17 of the sleeve so that the hooks and the sleeve are adjustably secured together by a bolt means through the slots and holes.

Figure 5:
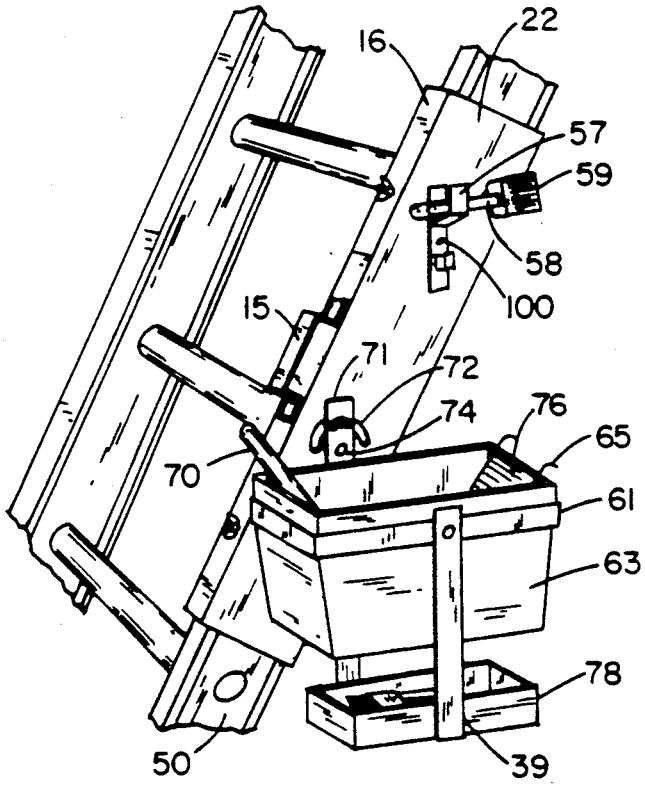
FIG. 5 is a partial perspective view of an extension-type ladder and mounted on the ladder a utility bracket mounted with a bracket for a paint bucket and utility tray and a holder for paint brushes and tools.

In FIG. 5 a means of attaching a utility device to the utility bracket comprises, through the elongated wide section of the sleeve 22, at least one arched half circle slot 72 and a hole 74 at the center of the arch, and a flat attaching surface 71 of a bracket 39 for attaching the utility device comprising two holes through the flat attaching surface separated by the radius of the arched half circle slot, so that bolt means through the holes of the flat attaching surface and the half circle slot and hole of the sleeve allow the utility device to be attached pivotally to the sleeve. A square-U-shaped rigid bracket 39 is pivotally attached to the sleeve and pivotally attached between open ends of the square-U-shaped rigid arm a self-enclosing strip 61 bolted together at connection 65, wherein the self-enclosing strip encompasses a paint bucket 63 and one of the sides of the square-U-shaped rigid arm forms the flat attaching surface with the holes for pivotally attaching the arm to the sleeve. The self enclosing strip 61 may be round to support a round paint bucket or rectangular in shape to support a rectangular paint bucket 63 secured within the self-enclosing strip. The bucket may be provided with a screen means 76 in the bucket secured to a top edge of the bucket and a paint roller 70 may be used with the bucket with the screen serving as a means to roll excess paint from the paint roller. A utility tray 78 may be attached to the square-U-shaped rigid arm below the paint bucket.

In FIG. 2 a square-U-shaped rigid arm 69 is pivotally attached to the sleeve and pivotally attached between open ends of the square-U-shaped rigid arm is a paint tray 12 with a paint roller 70 or utility tray for holding tools and other utility items, wherein one of the sides of the square-U-shaped rigid arm forms the flat attaching surface with the holes for pivotally attaching the arm to the sleeve.

Figure 8:
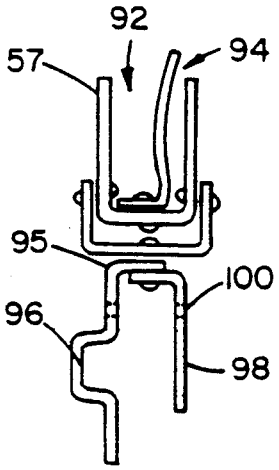
FIG. 8 is an elevational view partially in section showing a holder for paint brushes and tools.

In FIGS. 4, 5 and 8 a painting tool holder 57 comprises an elongated U-shaped clip for receiving and holding a painting tool 59 such as a brush by friction. The means of attaching the painting tool holder to the utility bracket comprises, through the elongated wide section 22 of the sleeve, at least one hole, and a flat attaching surface 98 of the painting tool holder for attaching the utility device comprising at least one mating hole 100 through the flat attaching means, so that bolt means through the holes of the flat attaching surface and holes of the sleeve allow the utility device to be attached pivotally to the sleeve. The painting tool holder 57 comprises a clamp means 92 for a painting tool such as a brush 59 and a second clamp means 94 for another tool such as a putty knife 58. Rotatably attached to the painting instrument holder by rotatable attaching means, another clamping means 95 comprises a flat attaching surface 98 removably securing the painting instrument holder to the sleeve by a bolt means through hole 100. An adjacent parallel arm having a square-U-shape bend 96 in a parallel arm facing away from the flat attaching surface so that the painting tool holder may be removed from the sleeve and attached to a top of a paint can with the square-U-shape bend fitting over a lip inside the top of the paint can and the flat attaching surface contacting an outside surface of the paint can removably securing the painting tool holder to the paint can.

Figure 6:
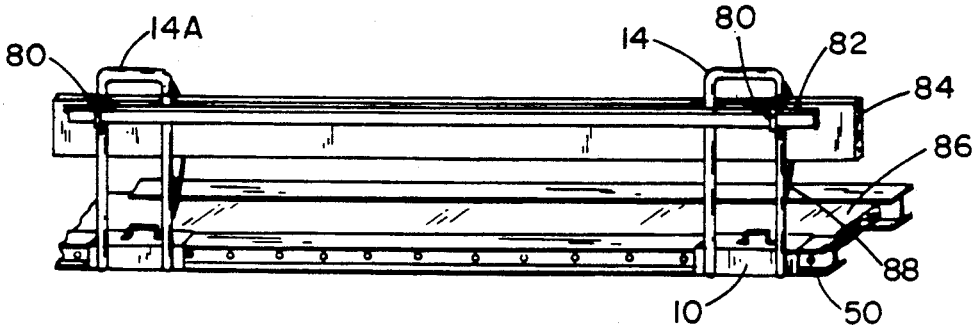
FIG. 6 is a partial perspective view of an extension-type ladder placed horizontally for use as staging with a plank placed on the ladder and mounted on the ladder two utility brackets mounted with extentended hand railings used as safety railing supports.

In FIG. 6 extended hand railings form elongated U-shaped rigid safety rail supports 14A formed of bent tubing secured to the sleeve by at least two bolt means in each arm, thereby forming a strong upright support for a safety railing 82 formed by a beam such as a 2×4 secured within brackets 80 on adjacent utility brackets when the ladder 50 is positioned horizontally as a staging element holding a plank 86. A long bracket 88 attached to one of two sides of the U supports building materials 84, such as siding, within the long bracket so that it does not clutter the plank.

The preferred material for the utility bracket is bent sheet metal, although it is understood that any strong sheet material may be used.

It is understood that the preceding description is given merely by way of illustration and not in limitation of the invention and that various modifications may be made thereto without departing from the spirit of the invention as claimed.

I claim:

1. A movable utility bracket for ladders comprising:

a sleeve contacting and conforming to a side rail of a ladder, wherein the sleeve extends over a length of the side rail equal to a distance between at least two ladder rungs, wherein a narrow elongated section of the sleeve covers a top edge of the side rail of the ladder and, extending orthogonally from the narrow elongated section, an elongated wide section covering the external side of the side rail, and permanetly secured to a top central portion of the sleeve a handle means for moving the utility bracket;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder, wherein the two hooks are attached together by a narrow elongated rigid strip which underlies the narrow elongated section of the sleeve and the hooks are adjustably and removably attached to the sleeve, and wherein the hooks are arched away from the narrow elongated rigid strip to conform to the rungs of an extension ladder, and the hooks are spaced a short distance from the narrow elongated rigid strip corresponding to the distance between an edge of a side railing and a rung on an extension ladder; wherein the narrow elongated section of the sleeve further comprises two transverse slots therethough and the narrow elongated strip further comprises two holes therethrough mating with the slots so that the hooks and the sleeve are adjustable secured together by a bolt means through the slots and holes; and a means of securing a utility device to the utility bracket for use by a person on the ladder, wherein the utility device comprises any of the following: a bracket for holding a paint bucket pivotally to the utility bracket, a bracket for holding a paint tray pivotally to the utility bracket, a bracket for holding a utility tray pivotally to the utility bracket, a bracket for holding a painting tool, a bracket for holding a tool, a hand rail rigidly secured to the utility bracket.

2. The invention of claim 1 further comprising a resilient arched strip secured within at least one of the hooks so that the arched strip and the hook are arched in opposing directions and the resilient arched strip extends across the width of the hook, so that when the hook is slipped over a ladder rung the resilient arched strip moves to admit the rung and then springs back to secure the rung within the hook.

3. A movable utility bracket for ladders comprising:

a sleeve contacting and conforming to a side rail of a ladder, wherein the sleeve extends over a length of the side rail equal to a distance between at least two ladder rungs, wherein a narrow elongated section of the sleeve covers a top edge of the side rail of the ladder and, extending orthogonally from the narrow elongated section, an elongated wide section covering the external side of the side rail, and permanently secured to a top central portion of the sleeve a handle means for moving the utility bracket;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder, wherein the two hooks are attached together by a narrow elongated rigid strip which underlies the narrow elongated section of the sleeve and the hooks are adjustably and removably attached to the sleeve, and wherein the base of each hook is a flat extension of the narrow elongated rigid strip and each hook is a flat extension of the narrow elongated rigid strip and each hook is formed of a flat rectangular arm bent at an angle away from the base of the hook, which angle corresponds to an angle between a side rail and a rung on a step ladder, and the hook further comprises a smaller rectangular end bent away from the flat rectangular arm at a right angle and extending a distance approximately equal to the thickness of a rung on a step ladder; wherein the narrow elongated section of the sleeve further comprises two transverse slots therethrough and the narrow elongated strip further comprises two holes therethrough mating with the slots so that the hooks and the sleeve are adjustably secured together by a bolt means through the slots and holes; and a means of securing a utility device to the utility bracket for use by a person on the ladder, wherein the utility device comprises any of the following: a bracket for holding a paint bucket pivotally to the utility bracket, a bracket for holding a paint tray pivotally to the utility bracket, a bracket for holding a utility tray pivotally to the utility bracket, a bracket for holding a painting tool, a bracket for holding a tool, a hand rail rigidly secured to the utility bracket.

4. A movable utility bracket for ladders comprising:

a sleeve contacting and conforming to a side rail of a ladder, wherein the sleeve extends over a length of the side rail equal to a distance between at least two ladder rungs, wherein a narrow elongated section of the sleeve covers a top edge of the side rail of the ladder and, extending orthogonally from the narrow elongated section, an elongated wide section covering the external side of the side rail, and permanently secured to a top central portion of the sleeve a handle means for moving the utility bracket;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder, wherein the two hooks are attached together by a narrow elongated rigid strip which underlies the narrow elongated section of the sleeve and the hooks are adjustably and removably attached to the sleeve; and a means of securing a utility device to the utility bracket for use by a person on the ladder, wherein the utility device comprises a hand railing and the means of attaching the utility device to the utility bracket comprises, through the elongated wide section of the sleeve, at least two holes with at least one hole positioned adjacent to each of two ends of the sleeve, and two arms of a hand railing each with at least one hole adjacent to each of two ends of the hand railing mating with the holes in the sleeve so that the hand railing is rigidly attached to the sleeve by bolting means; and wherein the hooks further comprise securing means across at least one opening across one hook to secure the hook around a ladder rung so that the utility bracket may be attached to a bottom side of a ladder on one side rail with a matching utility bracket on the other side rail so that the ladder may be rested on the hand railings against an external surface; and wherein bolted to the sleeve is an elongated U-shaped rigid safety rail support formed of bent tubing, thereby forming a strong upright support for a safety railing when the ladder is positioned horizontally as a staging element holding a plank, and wherein the elongated U-shaped rigid safety rail support further comprises a bracket to support a safety railing inserted between two utility brackets on the same side rail of the ladder positioned adjacent to each end of the ladder.

5. The invention of claim 4 wherein the elongated U-shaped rigid safety rail support further comprises a long bracket attached to sleeve for supporting building materials within the long bracket.

* * * * *